United States Patent [19]

Ohashi

[11] Patent Number: 4,616,486

[45] Date of Patent: Oct. 14, 1986

[54] APPARATUS FOR RETAINING COOLING PIPES FOR AN ICE RINK

[76] Inventor: Kazuo Ohashi, 46-6, 4-chome, Nukui, Nerima-ku, Tokyo, Japan

[21] Appl. No.: 747,109

[22] Filed: Jun. 20, 1985

[30] Foreign Application Priority Data

Aug. 10, 1984 [JP] Japan ..... 59-121981[U]

[51] Int. Cl.[4] ..... A63C 19/10

[52] U.S. Cl. ..... 62/235; 165/172; 248/68.1

[58] Field of Search ..... 62/235; 165/172; 248/68.1

[56] References Cited

U.S. PATENT DOCUMENTS

| | | | |
|---|---|---|---|
| 2,038,912 | 4/1936 | Summers | 165/172 |
| 2,896,887 | 7/1959 | Beltz | 248/68.1 |
| 2,997,770 | 8/1961 | Beltz | 62/235 |
| 3,285,334 | 11/1966 | Pasternak | 165/172 |
| 3,641,782 | 2/1972 | Timms | 62/235 |
| 4,164,975 | 8/1979 | Bottum | 165/172 |

FOREIGN PATENT DOCUMENTS 802602 10/1958 United Kingdom .

*Primary Examiner*—Ronald C. Capossela

*Attorney, Agent, or Firm*—Frishauf, Holtz, Goodman & Woodward

[57] ABSTRACT

An apparatus for retaining cooling pipes employed in an ice rink comprises a belt-shaped base member which is disposed on the floor portion of a rink and a supporting member which is integrally formed on the base member such as to project vertically therefrom. The retaining apparatus is made of flexible synthetic resin and retains cooling pipes at predetermined positions in the rink. The supporting member includes fitting notch portions for retaining the cooling pipes, the fitting notch portions each having a cut portion at the upper end thereof. The fitting notch portions for the pipes are provided at predetermined spacings over the length of the supporting member.

6 Claims, 10 Drawing Figures

APPARATUS FOR RETAINING COOLING PIPES FOR AN ICE RINK

BACKGROUND OF THE INVENTION

1. Field of the Invention

The present invention relates to an apparatus for retaining cooling pipes employed in an ice skating rink or the like which, and is disposed on the floor portion of the rink.

2. Description of the Prior Art

When an ice skating rink is artificially formed by making use of previously existing facilities such as a swimming pool, a stadium, the top of a building or the like, a multiplicity of cooling pipes are positioned on a floor of the rink, instead of having them embedded in the floor of the rink made of concrete materials or the like, so that they may be readily installed and removed at low cost. A refrigerant carrier such as brine flows through the cooling pipes. The rink is equipped with headers employed for both feed-out and feed-back, either on both sides or on one side thereof. The end portions of the cooling pipes are connected to each of the headers. These headers are further connected to a refrigerator or the like out of which the refrigerant carrier is fed. Circulation of the refrigerant carrier proceeds as follows; header for feed-out→cooling pipe→header for feed-back→refrigerator. The thus circulated refrigerant carrier freezes the water within the rink by thermal absorption.

Since however, the rink covers a considerably large area, a multiplicity of cooling pipes need to be arranged so as to extend over the rink at spacings as regular as possible. With this arrangement, it is feasible to freeze a large rink as well as to maintain a uniform quality of ice. Moreover, it is necessary to prevent positional deviation of the cooling pipes or any undesirable movement thereof which are caused by such factors as fluctuations of temperature at the time of freezing and the action of flowing water. For this reason, a plurality of cooling pipes are usually disposed in parallel with respect to each other at an equal distance, said cooling pipes being fixed on the floor portion of the rink. One known method involves an arrangement wherein retaining rods of wood or the like are disposed on the floor portion of the rink at predetermined intervals orthogonal to a multiplicity of cooling pipes, which are mounted on the retaining rods. The cooling pipes and the retaining rods are secured at junctions between them by fasteners such as metallic wire, string or a band.

Where this conventional method is employed, however, the above-mentioned fastening operation must be effected manually; hence, it requires much labour. Also, this kind of manual work creates other problems: It is difficult to adequately freeze the fastening portions, this being attributed to the fact that the wire, string, bands or the like employed for fastening hinder the fastening portions from being frozen; and the position of the fastening portions deviates due to the hydraulic pressure generated by the water flowing within the rink which causes variations in the space between cooling pipes, thus making it impossible to obtain ice of uniform quality over the entire frozen area of the rink. Furthermore, the cooling pipes are exposed, that is the cooling pipes are disposed such as not to be embedded in the floor portion of the rink but to be exposed on the surface thereof, the water tends to slosh back and forth or move along the disposed cooling pipes within the space of a large rink at the stage where the base-ice is formed, thereby leading to such a defect that the freezing speed decreases and the efficiency of the refrigeration process is lowered. If cooling pipes are installed by the conventional fastening method, there is no choice but to employ a relatively thick retaining rod. The use of a thick retaining rod, however, has the disadvantage that cracks are generated in the ice. Another known method for holding the cooling pipes involves an arrangement in which cooling pipes are positioned at predetermined intervals by means of thin spacers with flat shape, which are secured by nails or the like into the floor portion of the rink. However, when using such thin spacers with the cooling pipes exposed and not embedded in the floor portion of the rink, it occurs, at the stage of forming the base-ice, that the water accommodated in a broad area of the rink at a higher water level than the heights of the cooling pipes tends to slosh back and forth, or move along the disposed cooling pipes. The freezing rate thus is reduced and the efficiency of the refrigeration process is lowered. Furthermore, the cooling pipes in such method are substantially attached to the floor portion of the rink, and therefore ice cannot be formed between the pipes and the floor. This unfavorably reduces the strength of the ice to be formed, making it vulnerable to separation or cracking. Generally, both ends of the cooling pipes pass through a fence provided around the circumference of the rink and are connected to headers for feed-out and feed-back, these headers being provided on the outside of the fence. Such being the case, it often occurs that a gap is formed between the cooling pipe and the through-hole in the fence, and as a result, water leaks out through this gap.

SUMMARY OF THE INVENTION

Accordingly, it is a primary object of the present invention which was inspired by the above-described circumstances to provide an apparatus for retaining cooling pipes employed in an ice rink on a floor portion supporting the rink, which is capable of securely and simply retaining cooling pipes disposed at predetermined positions in the rink and which enables the cooling pipes to be removed with ease as well as providing for improvements in operation, said retaining apparatus being especially suited to cases in which an ice rink is established by making short term use of already-constructed facilities such as a swimming pool, stadium or the like in, for example, the winter season only.

To this end, according to one aspect of the invention, there is provided an apparatus for retaining cooling pipes employed in an ice rink on a floor portion supporting the rink, which is capable of restraining oscillatory motion or any undesirable movement of the water within a rink, enhancing the freezing efficiency thereof and further consolidating countermeasures against water-leakage.

According to another aspect of the invention, there is provided an apparatus for retaining cooling pipes employed in an ice rink on a floor portion supporting the rink, which can easily be carried and reused, and which causes no obstruction to ice-formation or its maintenance, and does not in any case cause cracks on the ice.

Other objects and features of the present invention will become evident on reading the following description with reference to the accompanying drawings.

BRIEF DESCRIPTION OF THE DRAWINGS

FIG. 3 is an elevational view thereof;

FIG. 4 is a side view thereof;

FIG. 5 is a perspective view thereof;

FIG. 6 is an elevational view thereof;

FIG. 7 is a perspective view thereof;

FIG. 8 is an elevational view thereof;

FIG. 9 is a side view thereof; and

DESCRIPTION OF THE PREFERRED EMBODIMENTS

One embodiment according to the present invention will hereinafter be described with reference to the accompanying drawings.

Figure 1:
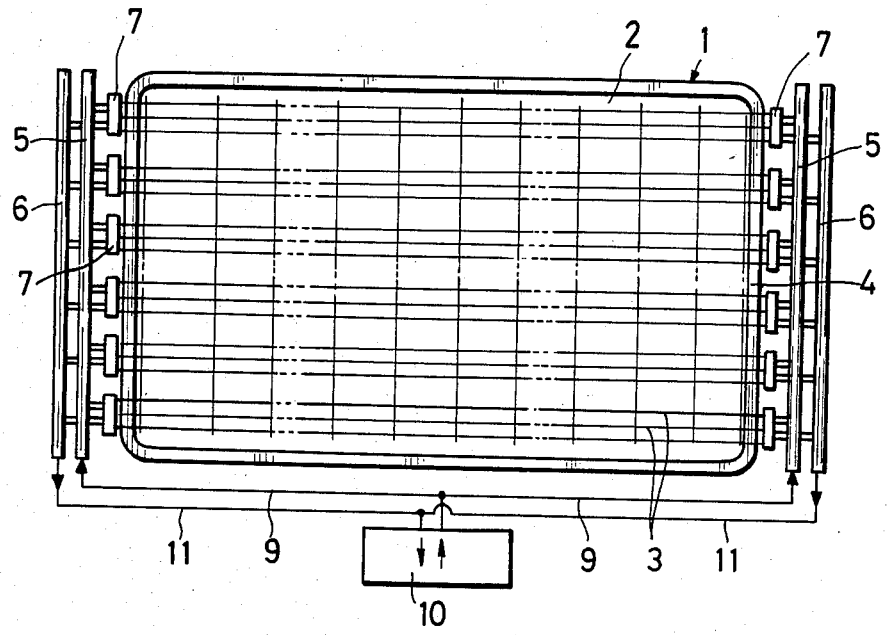
FIG. 1 is a schematic plan view of an ice rink, provided for the purpose of illustrating the present invention a whole.
Figure 2:
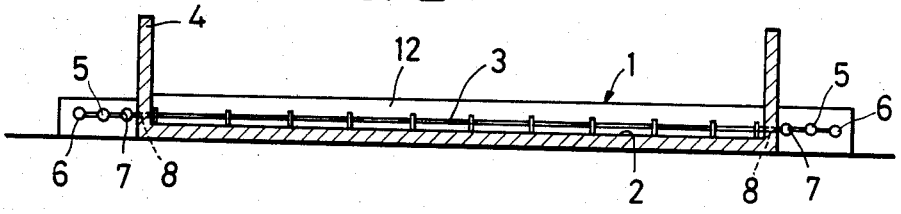
FIG. 2 is a sectional view thereof.

In FIGS. 1 and 2, the reference numeral 1 respresents, for example, a rink for ice skating. A multiplicity of cooling pipes 3 are provided on the floor portion 2 within the rink 1 such as to be disposed in the longitudinal direction thereof. The cooling pipes 3 are disposed at predetermined spaces in the widthwise direction of the rink 1, preferably at regular intervals. Headers 5 for feed-out and headers 6 for feed-back are provided parallel to each other at the outward portion of a fence 4 on both sides of the longitudinal direction of the rink 1, the headers 5 for feed-out being connected to one end of each of the above-mentioned cooling pipes through a plurality of sub-headers 7, while the headers 6 for feed-back being connected to the other end of each of the cooling pipes 3 through the sub-headers 7. Each of both ends of the cooling pipes 3 penetrates through-holes 8 formed in the fence 4.

Furthermore, the headers 5 for feed-out are connected to a refrigerator 10 through a feed-out tube 9, whereas the headers 6 for feedback are connected to the refrigerator 10 through a feedback tube 11. The refrigerator 10 is constituted by a compressor and a condenser. Namely, the refrigerator has such a mechanism that Freon as a refrigerant carrier is condensed, and thereafter it feeds in the thus condensed refrigerant carrier to each of the cooling pipes 3 in the case of the rink 1 being cooled by the so-called direct dilation method; while on the other hand, in the case of the so-called indirect freezing method, brine as a secondary refrigerant carrier is cooled and the thus cooled brine is then sent through the cooling pipes 3. In either case, the refrigerant carrier is circulated through the cooling pipes 3 so as to freeze the water 12 within the rink by absorbing the heat of the water therein.

The above-described cooling pipes 3 are formed of, for example, flexible synthetic resin. The outer diameter of the cooling pipe 3 is formed as thin as approximately 9.5 mm; and the inner diameter thereof, 7.0 mm. These cooling pipes 3 are retained on the floor portion of the rink 1 by means of a retaining apparatus which is shown in FIGS. 3 to 5.

Figure 3:
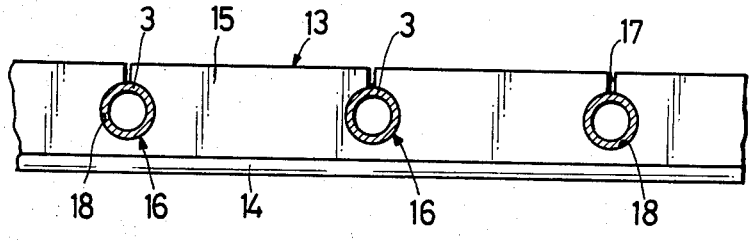
FIGS. 3 to 5 in combination show one embodiment of an apparatus for retaining cooling pipes employed in an ice rink, according to the present invention.
Figure 4:
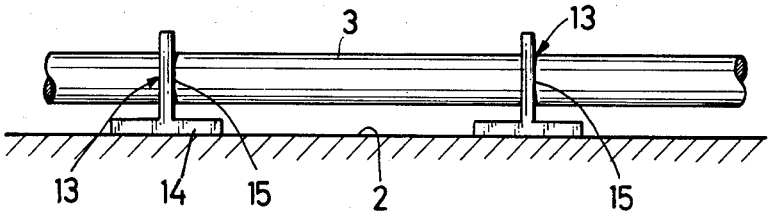
Figure 5:
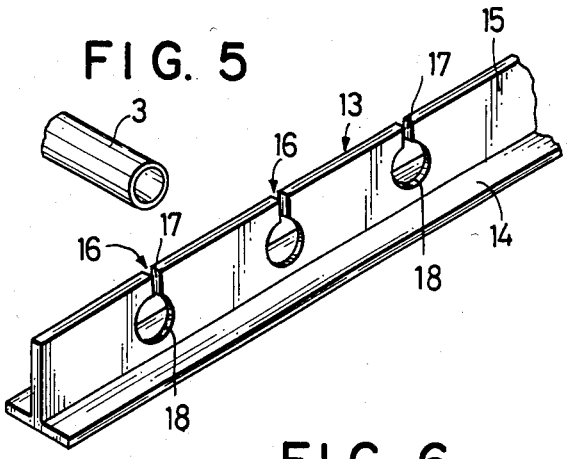

In FIGS. 3 to 5, the numeral 13 stands for a body of the retaining apparatus for cooling pipes, the body 13 being integrally formed of flexible synthetic resin. The body 13 includes a belt-shaped base member 14 and a relatively thin supporting member 15 which is integrally formed with the base member 14 such as to project vertically therefrom and extend along base member 14. The sectional configuration of the retaining apparatus is an inverted T-shape. Furthermore, a plurality of fitting notch portions 16 for retaining the cooling pipes are provided at predetermined spaces in the longitudinal direction, or preferably at regular intervals in the supporting member 15. The fitting notch portion 16 consists of a narrow cut portion 17 which extends to the upper end thereof and an engagement portion 18 which is so formed as to be integral therewith. The diameter of the engagement portion 18 is substantially identical with the outer diameter of the cooling pipe 3. Hence, the cooling pipe 3 is placed on the cut portion 17 of the fitting notch portion 16 and is then fitted by pressing downward on the engagement portion 18 such as to stretch out the cut portion 17. Once pipe 3 is in place in engagement portion 18, then the cut portion 17 is narrower than the outer diameter of the cooling pipe 3, the cooling pipe 3 can not easily be pulled out. Thus, the retaining apparatus is arranged so that the cooling pipe 3 is simply pressed in the cut portion 17 and, as a result, is retained by the fitting notch portion 16. The cooling pipe 3 is fitted in the fitting notch portion 16, so that it is by no means pulled out upwardly even though hydraulic pressure is applied thereto.

The body 13 of the thus constituted retaining apparatus is disposed on the floor portion of the rink 1 in the widthwise direction thereof, that is, in a direction orthogonal to the cooling pipes 3. The base member 14 is installed on the floor portion 2 by bonding or other arbitrary fixing means. Thereafter, the bodies 13 are installed by pushing them against the inner surface of the fence 4, at both ends thereof in the longitudinal direction of the rink 1. The supporting member 15 is arranged to blockade the through-holes 8; hence, it is feasible to prevent the water within the rink 1 from leaking out of the through-holes 8.

Figure 6:
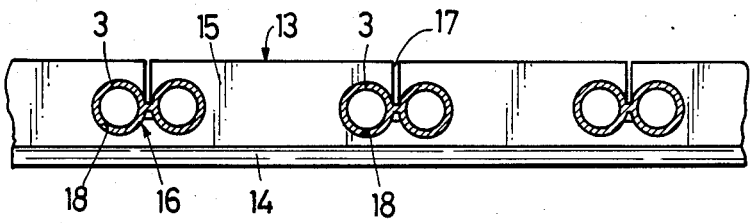
FIGS. 6 and 7 show another embodiment of an apparatus for retaining cooling pipes employed in an ice rink according to the present invention.
Figure 7:
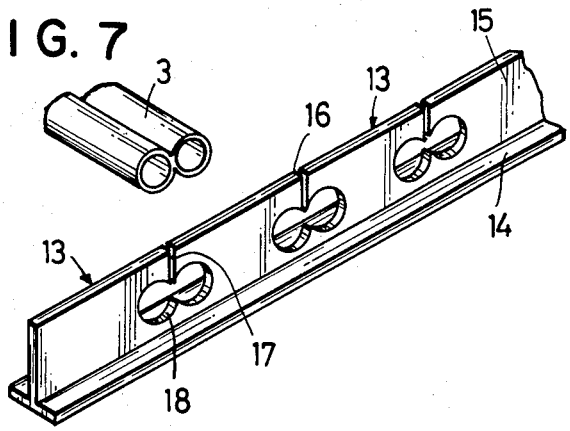

FIGS. 6 and 7 in combination show another embodiment of an apparatus for retaining cooling pipes employed in an ice rink according to the present invention, and this embodiment is applied to cases wherein tandem cooling pipes 3 are employed. These tandem cooling pipes 3 are used to alternately change the flow-direction of a refrigerant carrier in the cooling pipes in that, if the refrigerant carrier such as Freon, brine or the like always flows in the same direction, there is a difference in the freezing degree between the headers 5 for feed-out and the headers 6 for feed-back, the difference being derived from factors such as fluctuations of temperature of the refrigerant carrier. In this embodiment, the engagement portions 18 in which the tandem cooling pipes 3 are capable of being fitted are provided in the supporting member 15 of the body 13. With this arrangement, it is possible for the cooling pipe 3 to be securely fitted in the fitting notch portion 16, in the same manner as in the previous embodiment, by a method wherein the cooling pipe 3 is pressed in from the cut portion 17.

Figure 8:
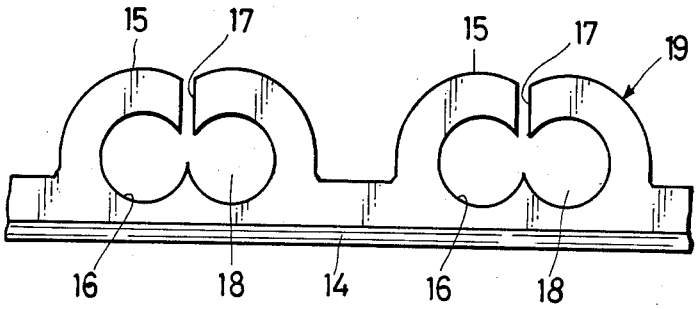
FIGS. 8 and 9 show still another embodiment of an apparatus for retaining cooling pipes employed in an ice rink according to the present invention.
Figure 9:
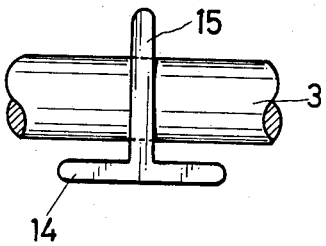
Figure 10:
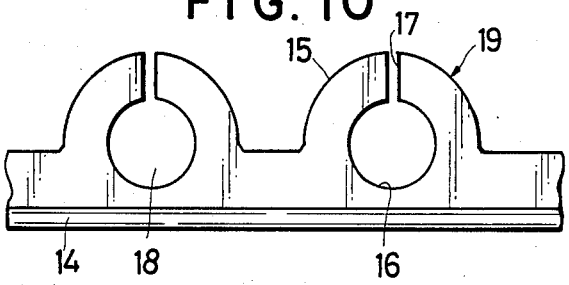
FIG. 10 is an elevational view, showing a further embodiment of an apparatus for retaining cooling pipes employed in an ice rink according to the present invention.

FIGS. 8 and 10 in combination show still another embodiment of an apparatus for retaining cooling pipes employed in an ice rink according to the present invention. In this embodiment, with respect to the sectional configuration of the supporting member 15, it takes a shape not of a rectangle but an undulating configuration which corresponds to the sectional configuration of the cooling pipes 3, the undulation involving raised portions 19 in a semi-arc configuration which are formed at predetermined spaces. Namely, when employing tandem cooling pipes 3, each of the raised portions 19 is, as illustrated in FIGS. 8 and 9, formed in a semi-elliptical shape; and in the case of using the single cooling pipe 3, the portion 19 is, as shown in FIG. 10, formed in a schematically semicircular shape. As the configuration of the supporting member 15 is wavy, the same portion 15 sufficiently adapts itself to the ice even if the ice layer within the rink is relatively thin. The ice in the vicinity of the supporting member 15 is uniform in quality; hence, it is possible to completely avoid cracks on the ice.

According to the present invention, as described above, the cooling pipe, which is provided on the floor portion of the rink, is pressed in the fitting notch portion of the body of the retaining apparatus by an extremely simple operation so as to be securely retained by this notch portion, the retaining apparatus being integrally formed of flexibile synthetic resin. Consequently, it is feasible to improve the efficiency of installing the cooling pipes and facilitate the removal thereof in a state wherein they may be re-employed. These advantages further make it possible to economically establish an ice rink in the skating season, especially in multi-purpose facilities. Moreover, the supporting member of the body of the retaining apparatus is provided on the floor portion of the rink as to project vertically therefrom, so that the supporting member 15 serves as a kind of wall which hinders oscillatory motion or any undesirable movement of the water within the rink. Owing to this arrangement, it is feasible to increase the rate of thermal exchange of the water and the refrigerant carrier flowing through the cooling pipes and also accelerate the freezing velocity at the time of producing ice. Moreover, with this arrangement, it is possible to increase the freezing effectiveness and foster the stabilization thereof.

Also, if the body of the retaining apparatus is so provided as to come into contact with the fence of the rink, the supporting member blockades the through-holes formed in the fence for insertion of the cooling pipes, this leading to an effect that the leakage from the through-holes can be prevented.

What is claimed is:

1. An apparatus for retaining cooling pipes employed in an ice rink, comprising:

at least one belt-shaped base member which is disposed on the floor portion of a rink; and a supporting member integrally formed with said base member to project vertically therefrom above the height of upper ends of said cooling pipes, said supporting member including fitting notch portions for retaining said cooling pipes at positions over and above the floor portion of the rink and at predetermined spacings over the length of said supporting member, and further including cut portions at respective upper ends of said fitting notch portions, wherein said retaining apparatus is made of flexible synthetic resin and retains said cooling pipes at predetermined positions in said ice rink so that ice forms directly about and beneath the cooling pipes when a liquid is provided on the floor portion and coolant is circulated in the pipes, said liquid being prevented by said supporting member from movement across the floor portion in the direction of the pipes.

2. An apparatus for retaining cooling pipes employed in an ice rink according to claim 1, wherein said supporting member is formed in an undulating configuration with respect to the sectional configuration which involves raised portions formed at predetermined spacings in the longitudinal direction thereof, said raised portions each having a semicircular shape or a semi-elliptical shape.

3. An apparatus for retaining cooling pipes employed in an ice rink according to claim 2, wherein each of said fitting notch portions is provided in said raised portion of said supporting member.

4. An apparatus for retaining cooling pipes employed in an ice rink according to claim 2, wherein each of said fitting notch portions is so formed as to have a shape substantially corresponding to the sectional configuration of said cooling pipe.

5. An apparatus for retaining cooling pipes employed in an ice rink according to claim 1, wherein each of said fitting notch portions is so formed as to have a shape substantially corresponding to the sectional configuration of said cooling pipe.

6. An apparatus for retaining cooling pipes employed in an ice rink according to claim 1, wherein each of said cut portions of said fitting notch portions is smaller than said cooling pipe in regard to the diameter thereof.

* * * * *